US006374768B1

(12) United States Patent
McGuire

(10) Patent No.: US 6,374,768 B1
(45) Date of Patent: Apr. 23, 2002

(54) APPARATUS AND PROCESS FOR BOTTOM COATING BY EXTRUSION

(75) Inventor: Walter J. McGuire, Swedesboro, NJ (US)

(73) Assignee: Huntsman International LLC, Salt Lake City, UT (US)

( * ) Notice: Subject to any disclaimer, the term of this patent is extended or adjusted under 35 U.S.C. 154(b) by 0 days.

(21) Appl. No.: 09/416,080

(22) Filed: Oct. 12, 1999

Related U.S. Application Data

(60) Provisional application No. 60/104,547, filed on Oct. 16, 1998.

(51) Int. Cl.[7] ..... B05C 5/02

(52) U.S. Cl. ..... 118/44; 118/126; 427/356

(58) Field of Search ..... 118/305, 307, 118/201, 203, 207, 208, 209, 211, 213, 216, 255, 413, 414, 44, 126; 427/356, 358

(56) References Cited

U.S. PATENT DOCUMENTS 3,418,970 A * 12/1968 Phelps et al. ..... 118/410
3,521,602 A 7/1970 Coghill et al. ..... 118/410
4,343,259 A 8/1982 McConnel ..... 118/44
4,846,412 A * 7/1989 Morand ..... 242/55.3
5,611,860 A * 3/1997 Waech ..... 118/410

FOREIGN PATENT DOCUMENTS

EP 392625 * 4/1990

* cited by examiner

*Primary Examiner*—Richard Crispino
*Assistant Examiner*—Yewebdar T. T
(74) *Attorney, Agent, or Firm*—Kevin J. Boland

(57) ABSTRACT

An extrusion apparatus is described comprising an underside extrusion nozzle for extruding a substance onto an object from underneath the object, the nozzle comprising: a body and a manifold therein; a plurality of extrusion passages in the body extending between the body exterior surface and the manifold; and a scraper blade attached to the body adjacent to the passages and defining a reservoir between the exterior surface and the scraper blade. The extrusion apparatus may further comprise a stand for holding and biasing the nozzle in contact with an object conveyed above it.

16 Claims, 4 Drawing Sheets

APPARATUS AND PROCESS FOR BOTTOM COATING BY EXTRUSION

This application claims benefit to Provisional Application No. 60/104,547 filed Oct. 16, 1998.

TECHNICAL FIELD

The present invention relates generally to extrusion of an adhesive onto the underside of an object and more specifically, to the extrusion of isocyanate resin onto the bottom of a board in a Glulam operation.

BACKGROUND OF THE INVENTION

In the manufacture of structural lumber, individual boards or veneers may be joined together in layers with adhesive bonding between layers. The resulting lumber and the process itself are often referred to as "Glulam."

Typically, the Glulam process comprises conveying a board 11 on a conveyor 12 in direction "A" through a pair of adhesive-dampened rollers 14, 14'. The adhesive transfers from rollers 14, 14' to the upper 16 and lower 18 surfaces of board 11 respectively, and the board is stacked on top of one or more other boards 11' having a similar coating of adhesive thereon. Bottom roller 14' may be kept freshly coated with adhesive by continually turning through a first reservoir 22, and top roller 14 may receive a constant drip or spray of adhesive from a second reservoir 20. When a sufficient number of board layers have been stacked, the stack is pressed together while the adhesive cures.

Such a process using rollers to apply the adhesive is adequate for use with adhesives such as polyvinylacetates (PVAs), phenol-formaldehydes, and urea formaldehydes that have been historically used in such operations. Isocyanates-based adhesives, however, which have certain process advantages over other binders such as faster cycle times, the ability to use higher moisture content components, and a lack of formaldehyde emissions, cannot be used with rollers. Because isocyanates react with moisture in the ambient air, the binder hardens on the rollers, rendering them useless for applying a uniform coating.

Isocyanates can, however, be extruded directly onto a board surface, because in an extrusion process, the adhesive stays within piping or tubing until it is discharged from the extrusion nozzle. This prevents adhesive contact with moisture until the adhesive hits the board surface, where reaction with moisture is desired.

Referring now to FIG. 2 there is shown a typical extrusion nozzle 110, known in the art for extrusion of an adhesive from above a board 11 on top of the board as it is conveyed in the direction of arrow "B". Extrusion nozzle 110 comprises a body 200 that may simply be a pipe, capped on both ends with caps 210, and having a plurality of holes (not shown) penetrating through the pipe wall.

The appropriate adhesive is pumped into nozzle 110 through a pipeline or hose 215, and exits the nozzle through the holes in streams 220 that fall by gravity onto board 11. The plurality of holes and adhesive streams 220 therefrom create a series of evenly spaced lines on the board. The evenly-spaced lines assure a precise amount of glue is applied to provide the adequate coverage necessary to generate the bonding strength needed to conform to certain industry standards.

While such extrusion nozzles are well-known for extruding a substance onto the topside of an object, no adequate apparatus for extrusion of an adhesive onto the bottom surface of a board is known. Merely inverting nozzle 110 is inadequate, as gravity no longer works to the advantage of adhesive streams 220 exiting the nozzle holes, but instead works to pull the adhesive away from the board. So, although a standard extrusion nozzle could adequately substitute for roller 14 in a Glulam operation of FIG. 1, no apparatus to substitute for roller 14' has been available, thus limiting the use of isocyanates in Glulam operations.

The present invention proposes an apparatus that enables extrusion of adhesive onto the underside of an object, such as a board in a Glulam operation, from underneath the object.

SUMMARY OF THE INVENTION

In accordance with this invention, there is provided an extrusion apparatus comprising an underside extrusion nozzle adapted to extrude a substance onto an object from underneath the object, the underside extrusion nozzle comprising: a body having an exterior surface and a manifold therein; at least one extrusion passage in the exterior surface, and preferably a plurality of extrusion passages, with each passage connecting to the manifold; and a scraper blade attached to the body exterior surface adjacent to the passages and defining a reservoir between the exterior surface and the scraper blade.

The extrusion apparatus may further comprise a stand for holding an underside extrusion nozzle having a cylindrical body, and a conveyor adapted to convey the object on top of the extrusion nozzle tangentially to the body circumference and perpendicular to the scraper blade.

The stand may further comprise at each of a first end and a second end of the underside extrusion nozzle body: a mounting bracket attached to the end; a supporting leg containing therein a spring attached to the mounting bracket, the spring adapted to bias the underside extrusion nozzle in contact with the object on the conveyor.

The invention may also comprise a process for joining a first object having a topside and an underside, to a second object having a topside and an underside, the process comprising the steps:

a) conveying the first object in a first direction;

b) extruding adhesive from a fixed location beneath the first object onto the first object underside as the first object is conveyed past the location; and c) joining the first object underside together to the second object topside.

The process step (b) may further comprise extruding adhesive onto the first object topside from above the object simultaneously with extruding adhesive onto the first object underside from beneath the object.

The extrusion apparatus and process of this invention may be used with an adhesive based on an isocyanate resin.

It is to be understood that both the foregoing general description and the following detailed description are exemplary, but are not restrictive, of the invention.

BRIEF DESCRIPTION OF DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. The drawings include the following figures.

DETAILED DESCRIPTION OF INVENTION

Figure 1:
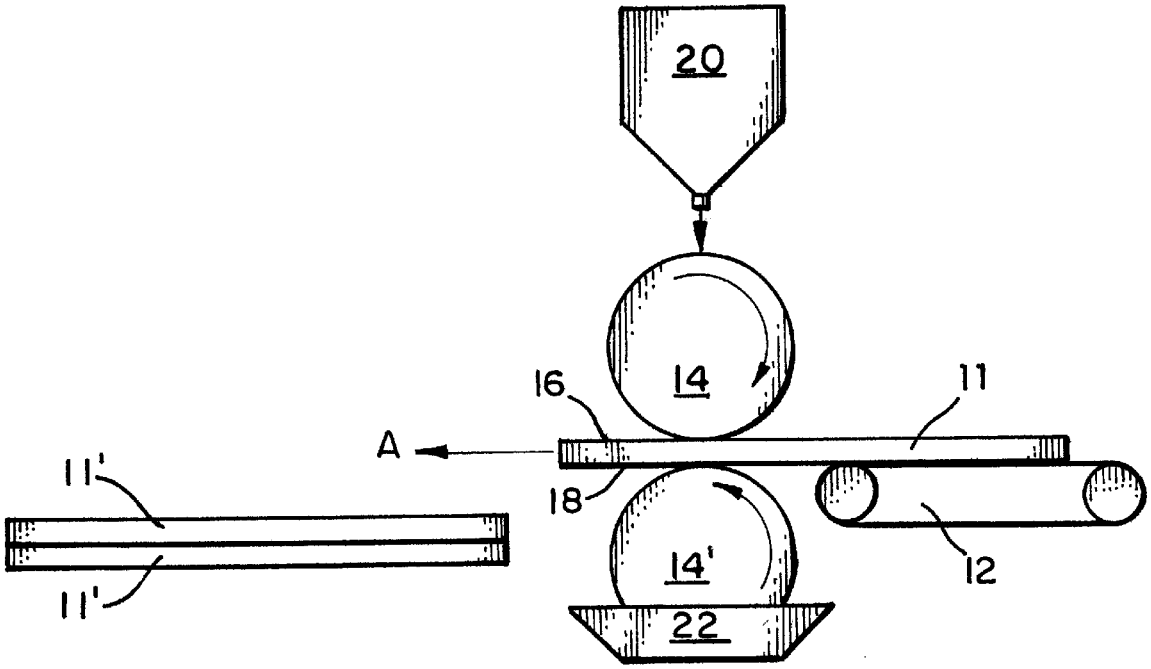
FIG. 1 PRIOR ART
FIG. 1 is a schematic illustration of a Glulam process of the prior art.
Figure 2:
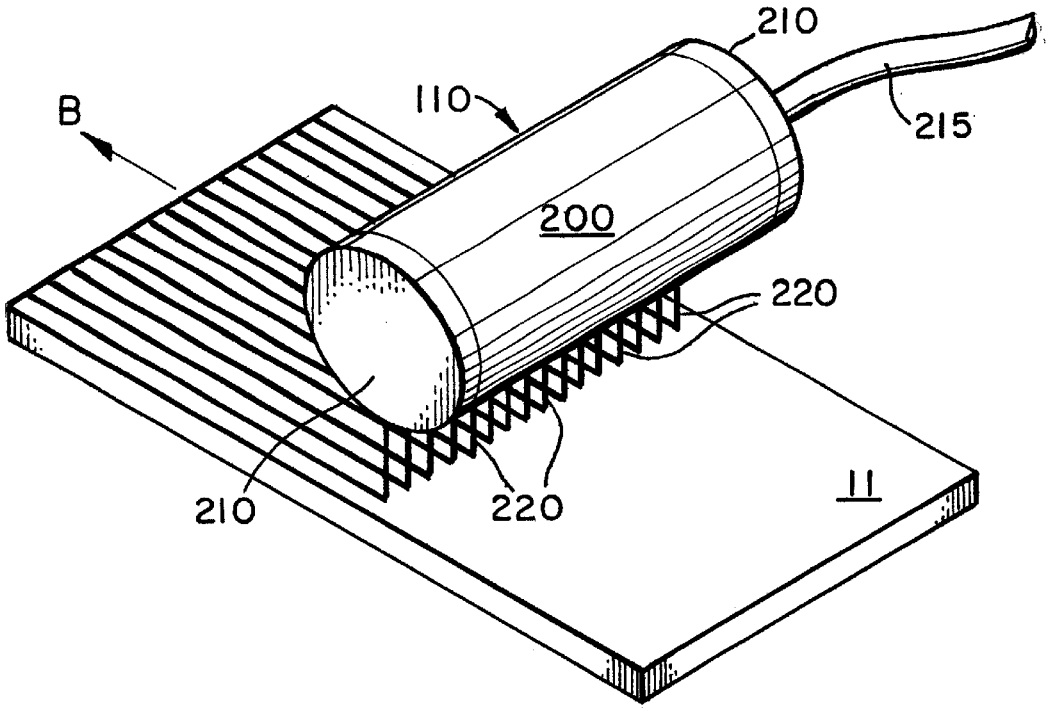
FIG. 2 PRIOR ART
FIG. 2 is a three-dimensional schematic illustration of a typical extrusion nozzle of the prior art for extrusion of adhesive onto the topside of a board.
Figure 3:
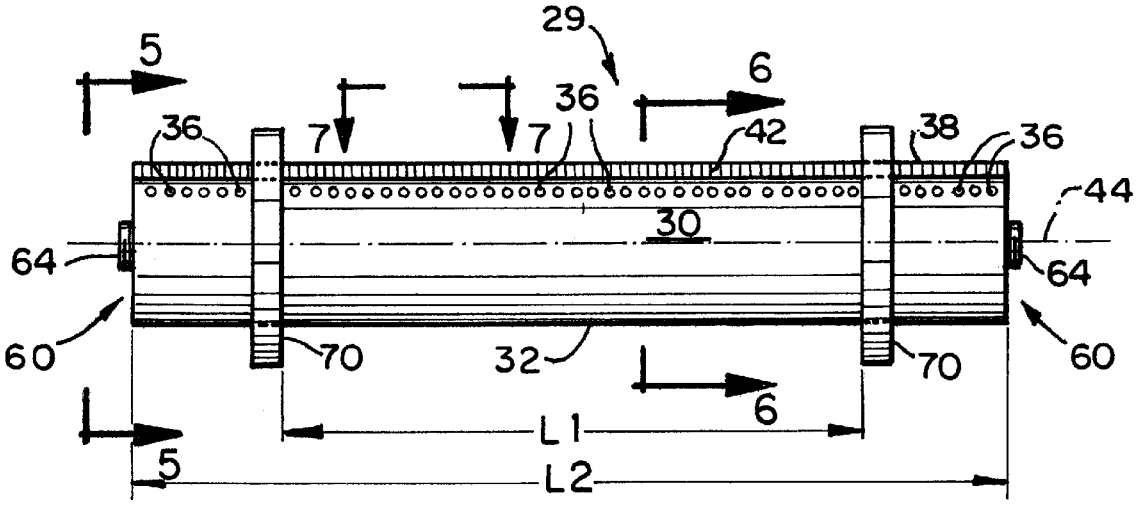
FIG. 3 is a schematic illustration of a top view of an underside extrusion nozzle of the present invention.
Figure 4:
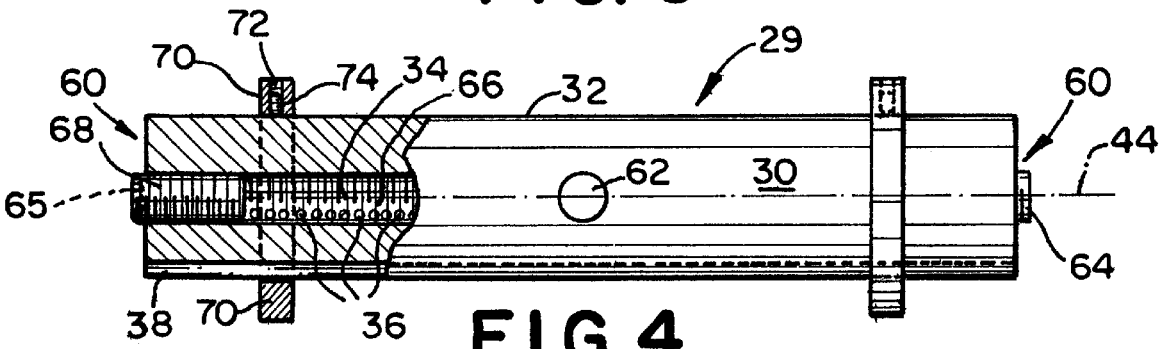
FIG. 4 is a schematic illustration of a bottom view and a partial longitudinal section of an underside extrusion nozzle of the present invention taken along arrows 4—4 of FIG. 3.
Figure 5:
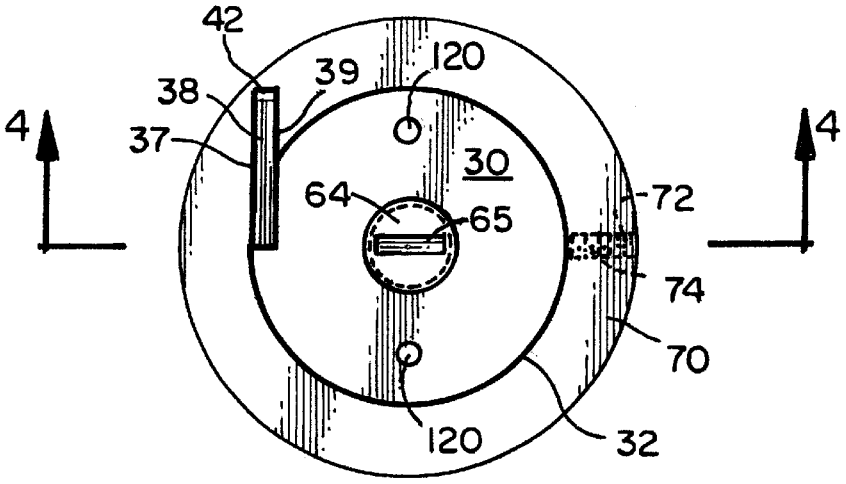
FIG. 5 is a schematic illustration of a end view of an underside extrusion nozzle of the present invention taken along arrows 5—5 of FIG. 3.

The invention will next be illustrated with reference to the figures wherein similar numbers indicate the same elements in all figures. Such figures are intended to be illustrative rather than limiting and are included herewith to facilitate the explanation of the apparatus of the present invention.

Referring now to FIGS. 3–7 there are shown schematic illustrations of the top (FIG. 3), bottom (FIG. 4), end (FIG. 5), cross-section (FIG. 6), and partial side views (FIG. 7), of an embodiment of the underside extrusion nozzle of the present invention. This nozzle is adapted to extrude a substance, such as a isocyanate adhesive, onto the underside of an object, such as a board, from underneath the object. Such an isocyanate adhesive may include, for example, but not limited to: Rubinate® 1075 isocyanate, Rubinate® 1073 isocyanate, or Rubinate® X1041 isocyanate, available from Huntsman Polyurethanes, West Deptford, N.J.

Underside extrusion nozzle 29 comprises a cylindrical body 30 having an exterior surface 32 and a manifold 34 therein. At least one, and preferably a plurality of evenly spaced extrusion passages 36 penetrate the exterior surface in a line along the length of the body and connect to the manifold 34. Optionally, instead of a plurality of individual extrusion passages 36, a single narrow slot could be used. A scraper blade 38 is attached to body 30 lengthwise on exterior surface 32 adjacent to passages 36, forming a reservoir 40 defined by the scraper blade inner surface 39 and the body exterior surface.

Figure 6:
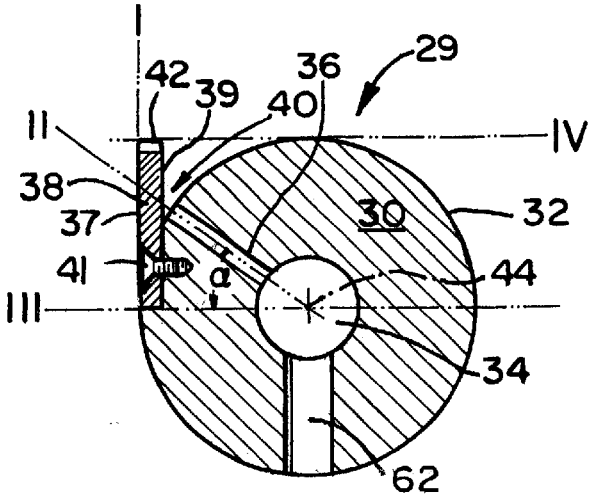
FIG. 6 is a schematic illustration of a cross-section of an underside extrusion nozzle of the present invention taken along arrows 6—6 of FIG. 3.
Figure 7:
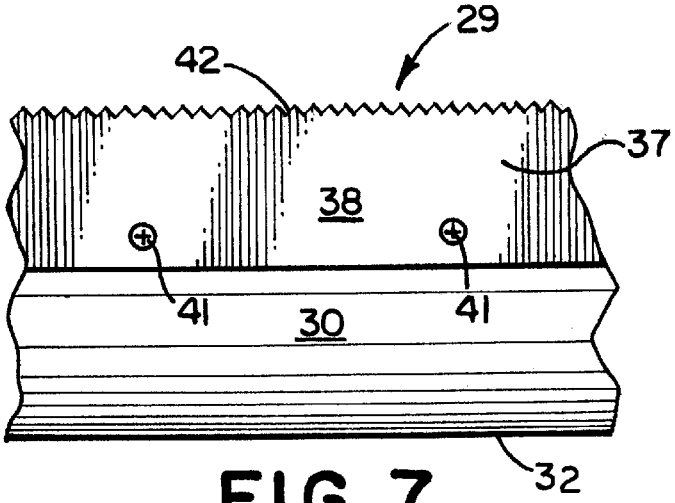
FIG. 7 is a schematic illustration of a partial side view of an embodiment of an underside extrusion nozzle of the present invention taken along arrows 7—7 of FIG. 3, showing the serrated top edge of the scraping blade.

The scraper blade 38 may be stiff and may further have a serrated top edge 42, as shown in FIG. 7, or it may be flexible. The scraper blade 38 may be either permanently or releasably attached to the body. For example, the scraper blade 38 may be welded or glued to the body, or attached with screws 41 as shown in FIGS. 6 and 7. The scraper blade 38 has an outer surface 37 and an inner surface 39, and the scraper blade is preferably mounted inset to body 30 so that the outer surface lies on a first reference plane (I) that is essentially tangential to the body circumference, as shown in FIG. 6. The extrusion passages 36 lie on a second reference plane II that runs through the centerline 44 through body 30. This second reference plane (II) is at a radial angle $\alpha$ of between 45 and 75 degrees from a third reference plane (III) that runs through the centerline 44 and is perpendicular to the first reference plane (I). The top edge 42 of scraping blade 38 preferably lies on a fourth reference plane (IV) that is perpendicular to the first reference plane (I) and tangential to the circumference of body 30.

Figure 8:
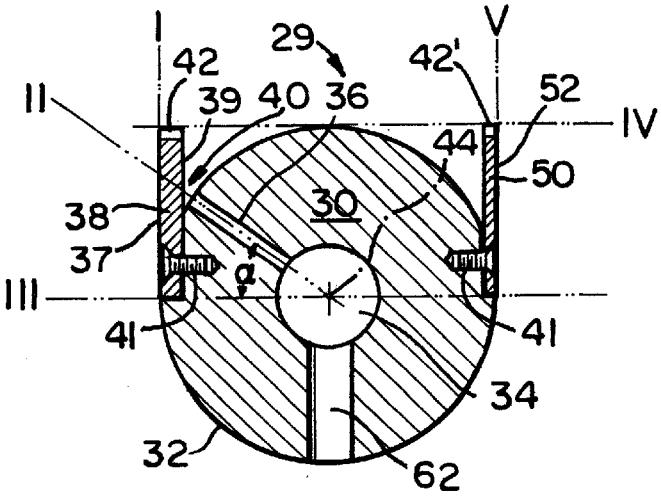
FIG. 8 is a schematic illustration of a cross-section of an alternate embodiment of an underside extrusion nozzle of the present invention having both a wiper blade and a scraper blade.

Referring now to FIG. 8, in an alternate embodiment, nozzle 29 may further comprise a wiper blade 50 having an outer surface 52 that lies on a fifth reference plane (V) that is essentially tangential to body 30 circumference and parallel to the first reference plane (I). Wiper blade 50 generally is flexible, while scraper blade 38 is stiff, but both blades may be flexible, or both stiff. Wiper blade 50 also has a top edge 42' that also lies on the fourth reference plane (IV).

Body 30 has two ends 60 and a central entry bore 62 connecting to the manifold 34. At each end, the manifold 34 may be adapted to adjustably receive a plug 64 that inserts in the manifold, each plug capable of being inserted to a variable depth into the manifold and capable of thereby blocking one or more extrusion passages. For example, the manifold 34 may be tapped with internal threads 66, and the plug may have external threads 68 allowing the plug to be threaded to whatever depth desired. Plug 64 may further have a slot 65 or other means adapted for use with a standard screwdriver or other adjusting tool.

In addition, adjacent each end 60, a retaining ring 70 closely fits around body 30 and scraper blade 38. Each retaining ring 70 is adapted to slide freely along the length of body 30, yet can be fixed at any point along the length, as desired. For instance, each retaining ring may have a threaded radial bore 72 extending from the inner to the outer surface of the ring, and a set screw 74 may be threaded therein. The set screw 74 is radially adjustable between a tightened position in compressive contact with body 30 and a loosened position not in contact with the body. Set screw therefore has a slot (not shown) or other means for receiving an adjusting tool such as a screwdriver.

Thus, the combination of retaining ring 70 and plug 64 allow the extrusion nozzle to be adjusted for the width of the board onto which it extrudes adhesive. For example, if the Glulam operation is adapted to work with boards of various widths between 2 and 12 inches, then the nozzle may be constructed with an end-to-end length "L1" of 14 inches. When the operation is used for processing 10-inch boards, the length between retaining rings "L2" may be adjusted to slightly above 10 inches, so that the boards will be guided within retaining rings 70. Similarly, the depth of plugs 64 can be adjusted so that extrusion passages 36 are blocked between retaining rings 70 and ends 60. In this way, adhesive is only extruded onto the board, and none is wasted.

Accordingly, whenever the process is retooled to process a different size board, a process operator or mechanic may merely adjust the retaining rings and the plugs without having to completely replace the nozzle. In the embodiment shown in FIG. 4, moving the retaining rings entails loosening set screws 74 away from being in compressive contact with body 30, sliding the rings to the desired position, and re-tightening the set screws to fix the retaining rings in place. Moving plugs 64 merely entails threading them deeper or shallower within manifold 34. Because entry bore 62 is centrally located in manifold 34, adhesive in the nozzle is trapped between the plugs and only extrudes out passages 36 located between the innermost ends of the plugs.

Figure 9:
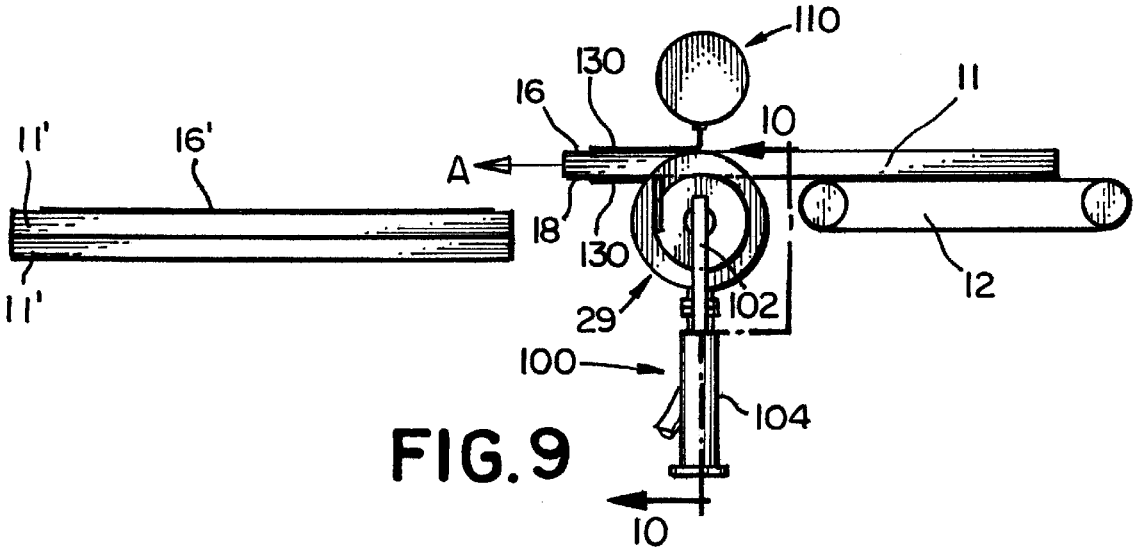
FIG. 9 is a schematic illustration of a Glulam process of the present invention using extrusion nozzles for topside and underside application of adhesive, and showing a side view of an embodiment of the stand for mounting the underside extrusion nozzle.

Referring now to FIG. 9, there is shown a schematic illustration of the underside extrusion nozzle 29 as used in a Glulam operation where a board 11 is conveyed by conveyor 12 between the underside extrusion nozzle and a standard topside extrusion nozzle 110. Both nozzles 29 and 110 simultaneously extrude adhesive 130 onto the upper 16 and lower 18 surfaces of the board 11. Underside extrusion nozzle 29 may be mounted on a stand 100 of the present invention using mounting brackets 102 attached at each end of the nozzle. The mounting brackets may attach to nozzle 29 at holes 120 (shown in FIG. 5). Topside extrusion nozzle 110 may be hung from piping brackets (not shown), or mounted in any way standard in the art.

Figure 10:
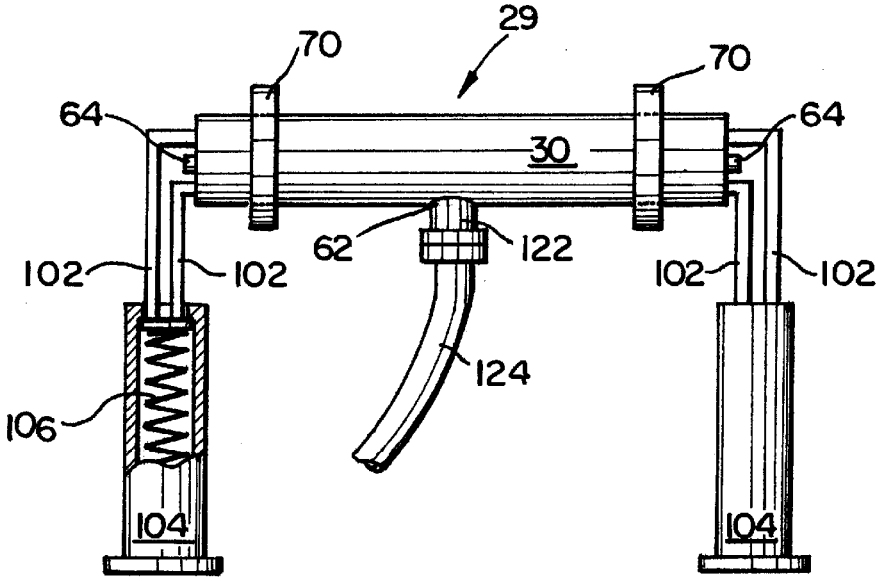
FIG. 10 is a schematic illustration of a front view of the stand of the present invention for mounting the underside extrusion nozzle, taken along arrows 10—10 in FIG. 9, showing a partial cutaway view of one leg to reveal the inner spring.

Referring now to FIG. 10 there is shown a schematic illustration of a front view of stand 100, showing brackets 102 that attach each end of nozzle 29 to a supporting leg 104 of the stand. Each supporting leg 104 contains therein a spring 106, as shown in the cutaway portion of FIG. 10. Each spring 106 is attached to a mounting bracket 102. The springs 106 together cooperatively bias underside extrusion nozzle 29 in contact with board 11 on conveyor 12.

Nozzle 29, as shown in FIG. 10, is supplied with adhesive through a connector 122 attached to central entry bore 62. Connector 122 may be a quick-connect that is adapted to fit a hose 124 connected to the glue supply (not shown), or may be any type of connector known in the art, including a hard-piped connection to the glue supply.

Thus, the process for joining board 11 to boards 11' in a Glulam operation comprises conveying board 11 in the direction of arrow "A" so that the underside 18 of board 11 travels along reference plane IV (shown in FIG. 6), and simultaneously extruding adhesive from nozzle 29 onto the underside and extruding adhesive from nozzle 110 onto the topside 16 of board 11 as it is conveyed past. Then the board 11 is stacked on board 11' so that board 11 underside 18 is glued to board 11' topside 16'.

The underside extrusion nozzle and process described herein may be used for processes other than Glulam operations, and may be used to extrude substances other than adhesives onto objects other than boards.

EXAMPLE

The following example is included to more clearly demonstrate the overall nature of the invention. This example is exemplary, not restrictive, of the invention.

A steel extrusion nozzle 29 having a cylindrical body 30 having a diameter of approximately 3.49 cm and a length of approximately 21 cm was manufactured, having a manifold 34 therein of approximately 1.27 cm. Manifold 34 was tapped with internal threads. A scraper blade 38 having a serrated top edge 42 was constructed out of 0.48 cm thick steel and bolted to a groove inset within the nozzle body 30, so that scraper blade outer edge 37 was essentially tangential to the circumference of the cylindrical body.

A plurality of approximately 0.16 cm diameter extrusion passages were arranged in a line, evenly spaced at 6 passages per linear inch along the central seven inches of the nozzle body. The angle $\alpha$ of reference plane II (through body centerline 44 and extrusion passages 36) to reference plane III (through the centerline perpendicular to plane I along the outer surface 37 of scraper blade 38) was approximately 60°.

Retaining rings 70 having outer radii of approximately 5.56 cm and an inner cutout conforming to the geometry of body 30 with scraper blade 38 mounted thereon were constructed. Each retaining ring 70 was drilled and tapped with a 0.48 cm bore 72 and a corresponding set screw 74 for fixing the ring in place against the body. The central entry bore 62 was drilled and tapped to fit a 1.91 cm NPT connection.

The nozzle was experimentally used to extrude Rubinate® 1075 isocyanate and Rubinate® 1073 isocyanate onto the underside of boards running through a Glulam process. The binder was applied at a rate of up to 538.4 grams/minute, and used on runs of boards of various wood types, widths, and number of lamina. The nozzle was able to deliver the precise dosage required with minimum residue. Boards produced during this experimental run were subjected to Japanese Agricultural Standard (JAS) 111—Bending Test A, and each type of board conformed to the Bending Strength, Modulus of Elasticity (MOE) and Modulus of Rupture (MOR) standards, with test results as shown in Table 1 below.

TABLE 1

| Wood Type | Sample size (mm) | # of Lamina | Bending Strength (kg) | MOE (1000 kg/cm$^2$) | MOR (kg/cm$^2$) |
|---|---|---|---|---|---|
| Lodgepole Pine | 100 × 100 | 5 | 2197 | 122 | 484 |
| Lodgepole Pine | 100 × 100 | 5 | 2332 | 103 | 514 |
| Douglas Fir | 105 × 105 | 5 | 2376 | 112 | 435 |
| Spruce | 120 × 120 | 5 | 2691 | 102 | 365 |
| Spruce | 120 × 295 | 12 | 5421 | 95 | 322 |

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. An extrusion apparatus comprising an underside extrusion nozzle adapted to extrude a substance onto an object from underneath the object, the underside extrusion nozzle comprising:

a body having an exterior surface, a first end and a second end and a central entry bore radially penetrating through said exterior surface to a manifold therein; said manifold having a first end and second end coextensive with said body first end and second end, respectively, each of said first and second end of said manifold adapted to adjustably receive a plug; said manifold further comprising at each of said first and second end, a plug adapted to insert therein, each plug capable of insertion at a variable depth into said manifold and capable of thereby blocking the manifold between the central entry bore and one or more of a plurality of extrusion passages spaced along a line extending from adjacent said body first end to adjacent said body second end; and a scraper blade attached to said body exterior surface adjacent to said passages and defining a reservoir between said exterior surface and said scraper blade.

2. An extrusion apparatus according to claim 1 wherein the plurality of extrusion passages are evenly spaced along said line extending from adjacent said body first end to adjacent said body second end.

3. An extrusion apparatus according to claim 2 wherein the body of said underside extrusion nozzle is cylindrical, having a circumference and a length, and the scraper blade has a length coextensive with the body length.

4. An extrusion apparatus according to claim 1 wherein said scraper blade has a serrated top edge.

5. An extrusion apparatus according to claim 3 wherein said scraper blade is flexible.

6. An extrusion apparatus according to claim 3 wherein said scraper blade has an inner and an outer surface, and wherein said scraper blade is mounted so that said outer surface lies on a first reference plane that is essentially tangential to said body circumference.

7. An extrusion apparatus according to claim 6 wherein said body has a centerline and said extrusion passages lie on a second reference plane through said centerline, and said second reference plane is at a radial angle of between 45 and 75 degrees from a third reference plane through said centerline and perpendicular to said first reference plane.

8. An extrusion apparatus according to claim 7 wherein said scraping blade has a top edge that lies on a fourth reference plane that is perpendicular to said first reference plane and tangential to said body circumference.

9. An extrusion apparatus according to claim 8 further comprising a wiper blade having an outer surface that lies on a fifth reference plane that is essentially tangential to said body and parallel to said first reference plane, said wiper blade also having a top edge that lies on said fourth reference plane.

10. An extrusion apparatus according to claim 1 wherein said underside extrusion nozzle further comprises adjacent each of said body first and second end, a retaining ring that closely fits around said body and said scraper blade, said ring adapted to slide freely along the length of said body and also adapted to be fixed at any point along said length.

11. An extrusion apparatus according to claim 10 wherein each retaining ring has an inner surface adjacent said body exterior surface and an outer space, a threaded radial bore extending from said inner to said outer surface, and a set screw therein, said screw radially adjustable between a position in compressive contact with said body and a position not in contact with said body.

12. An extrusion apparatus according to claim 8 further comprising:

a stand for holding said underside extrusion nozzle; and a conveyor adapted to convey said object on top of said extrusion nozzle along said fourth reference plane.

13. An extrusion apparatus according to claim 12 wherein said stand further comprises at each of the first end and the second end of said underside extrusion nozzle body:

a mounting bracket attached to said end; and a supporting leg containing therein a spring attached to said mounting bracket, said spring adapted to bias said underside extrusion nozzle in contact with said object on said conveyor.

14. An extrusion apparatus according to claim 12 further comprising:

a topside extrusion nozzle positioned above said underside extrusion nozzle and above said conveyor, said topside extrusion nozzle adapted to extrude the substance onto the topside of the object from above the object.

15. An extrusion apparatus according to claim 1 wherein said object is a board and said substance is an adhesive.

16. An extrusion apparatus according to claim 15 wherein said adhesive comprises an isocyanate-based resin.

* * * * *